US009308973B2

(12) United States Patent
Teppig, Jr.

(10) Patent No.: US 9,308,973 B2
(45) Date of Patent: Apr. 12, 2016

(54) LAUNCH AND RECOVERY DEVICE

(71) Applicant: Aeplog, Inc., Germantown, MD (US)

(72) Inventor: William M. Teppig, Jr., Mt. Airy, MD (US)

(73) Assignee: Aeplog, Inc., Potomac, MD (US)

( * ) Notice: Subject to any disclaimer, the term of this patent is extended or adjusted under 35 U.S.C. 154(b) by 55 days.

(21) Appl. No.: 13/687,467

(22) Filed: Nov. 28, 2012

(65) Prior Publication Data

US 2013/0136564 A1 May 30, 2013

Related U.S. Application Data

(60) Provisional application No. 61/564,146, filed on Nov. 28, 2011.

(51) Int. Cl.

| | |
|---|---|
| ***B63B 27/36*** | (2006.01) |
| *B63B 23/00* | (2006.01) |
| *B63B 27/16* | (2006.01) |

(52) U.S. Cl.

CPC ..... *B63B 27/36* (2013.01); *B63B 23/00* (2013.01); *B63B 2027/165* (2013.01)

(58) Field of Classification Search

CPC ..... B63B 21/00; B63B 27/26; B63B 23/00; B63B 2027/165; B63B 27/36

USPC ..... 414/137.7, 803; 114/267, 352, 375, 114/44–55, 365–380, 242–254, 221 A; 294/66.1; 405/1, 3

See application file for complete search history.

(56) References Cited

U.S. PATENT DOCUMENTS 1,773,999 A * 8/1930 Haight ..... B63B 35/52 114/123
2,896,564 A * 7/1959 Wright ..... B63B 27/36 104/70

(Continued)

FOREIGN PATENT DOCUMENTS

CN 202379066 8/2012
CN 202400265 8/2012

(Continued)

OTHER PUBLICATIONS

International Search Report and Written Opinion from corresponding PCT Application No. PCT/US2012/066804, dated Feb. 7, 2013, 10 pages.

(Continued)

*Primary Examiner* — Saul Rodriguez
*Assistant Examiner* — Lynn Schwenning
(74) *Attorney, Agent, or Firm* — Brian J. Colandreo; Michael T. Abramson; Holland & Knight LLP

(57) ABSTRACT

A method, apparatus, and computer program product for capturing a target object from a body of water. A first rail is proximate to a second rail. A first gap portion is formed between at least a portion of the first and second rail. The first gap portion is configured to align and receive at least a portion of the target object as a distance between the first gap portion and at least the portion of the target object decreases. A second gap portion is formed between at least the portion of the first and second rail. The first and second rail are further configured to align and receive at least the portion of the target object with the second gap portion as a distance between the second gap portion and at least the portion of the target object decreases.

25 Claims, 14 Drawing Sheets

(56) References Cited

U.S. PATENT DOCUMENTS

| | | | | |
|---|---|---|---|---|
| 3,364,895 | A * | 1/1968 | De Jong Sijtze et al. | 114/253 |
| 3,670,682 | A | 6/1972 | Leavitt et al. | |
| 3,823,564 | A * | 7/1974 | Crout | B63B 35/003 114/259 |
| 3,943,874 | A * | 3/1976 | Pipkin et al. | 114/221 A |
| 4,020,777 | A | 5/1977 | Brown et al. | |
| 4,086,777 | A * | 5/1978 | Lai | 405/195.1 |
| 4,876,979 | A * | 10/1989 | Walton et al. | 114/258 |
| 5,253,606 | A * | 10/1993 | Ortelli | B66C 13/02 114/259 |
| 5,927,226 | A * | 7/1999 | Patterson | 114/249 |
| 6,834,604 | B2 * | 12/2004 | O'Neil | B63B 1/02 114/44 |
| 6,883,453 | B1 | 4/2005 | Mulhern | |
| 7,055,447 | B1 | 6/2006 | Bekker | |
| 7,156,036 | B2 | 1/2007 | Seiple | |
| 7,347,157 | B2 | 3/2008 | Seiple | |
| 7,506,606 | B2 * | 3/2009 | Murphy et al. | 114/368 |
| 8,430,049 | B1 * | 4/2013 | Tureaud et al. | 114/259 |
| 8,590,473 | B1 * | 11/2013 | Caccamo et al. | 114/258 |
| 2005/0013663 | A1 * | 1/2005 | Basta | B63B 3/00 405/3 |
| 2005/0145154 | A1 | 7/2005 | De Baan | |
| 2009/0257826 | A1 | 10/2009 | Bergmann | |
| 2011/0203507 | A1 | 8/2011 | Ellnor | |

FOREIGN PATENT DOCUMENTS

| | | | | |
|---|---|---|---|---|
| GB | 2024111 | * | 1/1980 | |
| WO | WO 2010048665 | * | 5/2010 | B63B 1/12 |

OTHER PUBLICATIONS

International Preliminary Report on Patentability and Written from corresponding PCT Application No. PCT/US2012/066804, dated Jun. 3, 2014, 9 pages.

International Search Report and Written Opinion from corresponding PCT Application No. PCT/US2015/022161, dated Jun. 26, 2015, 9 pages.

Non-Final Office Action issued in related U.S. Appl. No. 14/666,539 on Nov. 27, 2015.

Notification of the First Office Action issued on Dec. 30, 2015 n related application Serial No. CN 2012800583038.

* cited by examiner

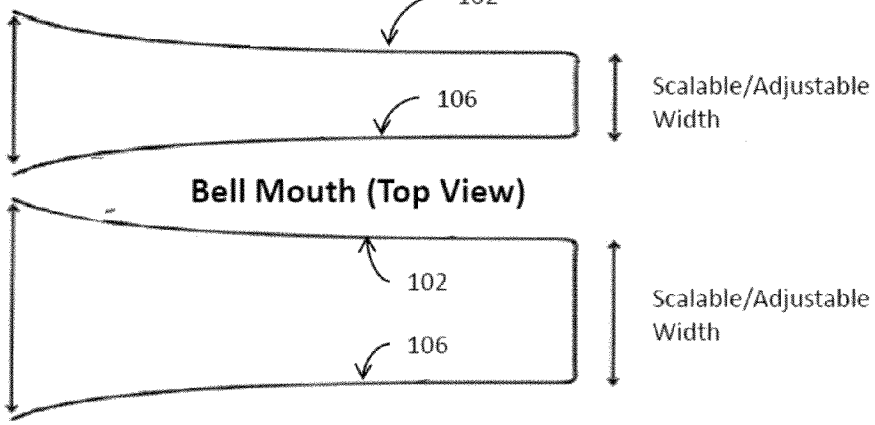
Figure 6A (Widening):
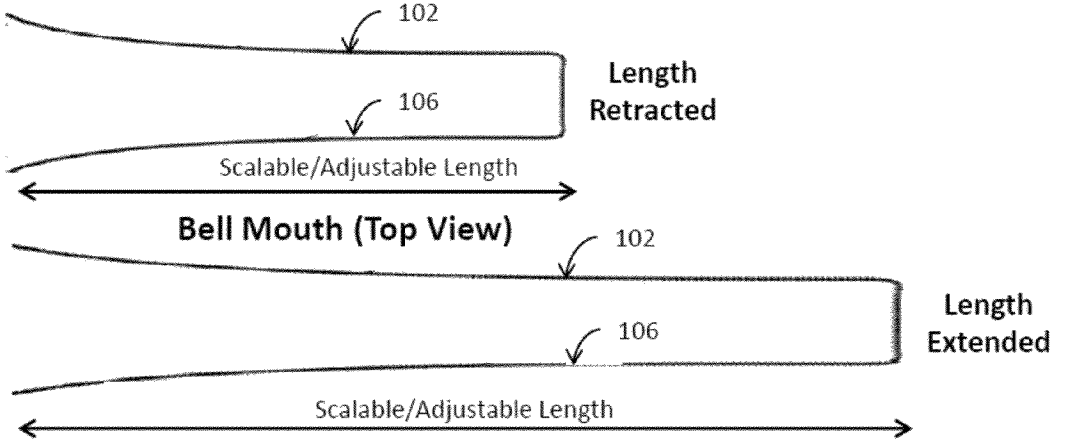
Figure 6B (Lengthening):

1000

LAUNCH AND RECOVERY DEVICE

RELATED CASES

This application claims the benefit of U.S. Provisional Application No. 61/564,146, filed on 28 Nov. 2011, by William Teppig JR., entitled In-situ Launch and Recovery (ILR) Device, the contents of which are all incorporated by reference.

BACKGROUND

Vessels (e.g., cargo vessels) may be used to transport goods between land and ships (e.g., cargo ships). Delivering the cargo vessels from land to the ships may be accomplished by, e.g., floating the cargo vessel to the ship and recovering the cargo vessel using, e.g., a "capture vessel", "capture structure", "capture object", etc. Recovering such cargo vessels from, e.g., the surface or near surface of the water (e.g., ocean, lake, etc.) may prove onerous for multiple reasons. For example, the dynamic displacements between the capture vessel and the target vessel (e.g., the cargo vessel) may be unpredictable and elusive. For instance, to satisfactorily align, e.g., a crane, to the target vessel in the water may require the crane to respond (e.g., instantly) to the varying degrees of freedom (e.g., pitch, roll, heave, and yaw of both the crane and target vessel).

BRIEF SUMMARY OF DISCLOSURE

In one implementation, an apparatus configured to capture a target object from a body of water comprises a first rail proximate to a second rail. A first gap portion is formed between at least a portion of the first and second rail. The first gap portion is configured to align and receive at least a portion of the target object as a distance between the first gap portion and at least the portion of the target object decreases. A second gap portion is formed between at least the portion of the first and second rail. The first and second rail are further configured to align and receive at least the portion of the target object with the second gap portion as a distance between the second gap portion and at least the portion of the target object decreases.

One or more of the following features may be included. One or more stabilizing portions may be configured to stabilize the first and second rail. The one or more stabilizing portions may include one or more ballasts. The one or more stabilizing portions may include one or more portions configured to receive one or more cables operatively connected to a crane. The one or more ballasts may be configured to dynamically stabilize the first and second rail. The one or more ballasts may include a cylinder with one or more slots. At least one of the first and second rail may be further configured to extend and retract. At least one of a motor, an engine, and a thruster may be configured to navigate at least one of the first and second rail. A catch may be configured to, after at least the portion of the target object is proximate to the catch, prevent at least the portion of the target object from moving in one or more directions. At least one of the first and second rail may include at least one of a straight and a curved shape.

In another implementation, an apparatus configured to capture a target object from a body of water comprises a first rail proximate to a second rail. A third rail is proximate to a fourth rail. A first gap portion is formed between at least a portion of the first and second rail. The first gap portion is configured to align and receive at least a portion of the target object as a distance between the first gap portion and at least the portion of the target object decreases. A second gap portion is formed between at least the portion of the first and second rail. The first and second rail is further configured to align and receive at least the portion of the target object with the second gap portion as a distance between the second gap portion and at least the portion of the target object decreases. A third gap portion is formed between at least a portion of the third and fourth rail. The third gap portion is configured to align and receive at least a second portion of the target object as a distance between the third gap portion and at least the second portion of the target object decreases. A fourth gap portion is formed between at least the portion of the third and fourth rail. The third and fourth rail is further configured to align and receive at least the second portion of the target object with the fourth gap portion as a distance between the fourth gap portion and at least the second portion of the target object decreases.

One or more of the following features may be included. One or more stabilizing portions may be configured to stabilize at least one of the first, second, third, and fourth rail. The one or more stabilizing portions may include one or more ballasts. The one or more stabilizing portions may include one or more portions configured to receive one or more cables operatively connected to a crane. The one or more ballasts may be configured to dynamically stabilize at least one of the first, second, third, and fourth rail. The one or more ballasts may include a cylinder with one or more slots. At least one of the first, second, third, and fourth rail may be further configured to extend and retract. At least one of a motor, an engine, and a thruster may be configured to navigate at least one of the first, second, third, and fourth rail. A catch may be configured to, after at least the portion of the target object is proximate to the catch, prevent at least the portion of the target object from moving in one or more directions. At least one of the first, second, third, and fourth rail may include at least one of a straight and a curved shape.

In another implementation, a method for capturing a target object from a body of water comprises aligning a first gap portion formed between at least a portion of a first and second rail coupled to a capture object with at least a portion of the target object. At least the portion of the target object is received at the first gap portion as a distance between the first gap portion and at least the portion of the target object decreases. A second gap portion formed between at least the portion of the first and second rail is aligned with at least the portion of the target object. At least the portion of the target object is received at the second gap portion as a distance between the second gap portion and at least the portion of the target object decreases.

One or more of the following features may be included. Aligning at least one of the first and second gap portion may include stabilizing at least one of the first and second rail using one or more ballasts. At least one of the first and second rail may be dynamically stabilized via, at least in part, the one or more ballasts. Aligning at least one of the first and second gap portion may include at least one of extending and retracting at least one of the first and second rail. Aligning at least one of the first and second gap portion may include navigating at least one of the first and second rail via at least one of a motor, an engine, and a thruster. At least the portion of the target object may be prevented from moving in one or more directions via a catch after at least the portion of the target object is proximate to the catch. At least the portion of the target object may be lifted in a vertical direction after at least one of the first and second gap portion is aligned and received.

The details of one or more implementations are set forth in the accompanying drawings and the description below. Other features and advantages will become apparent from the description, the drawings, and the claims.

BRIEF DESCRIPTION OF THE DRAWINGS

FIGS. 6A and 6B are illustrative diagrammatic views of an apparatus according to one or more implementations of the present disclosure;

Like reference symbols in the various drawings indicate like elements.

DETAILED DESCRIPTION

Figure 1:
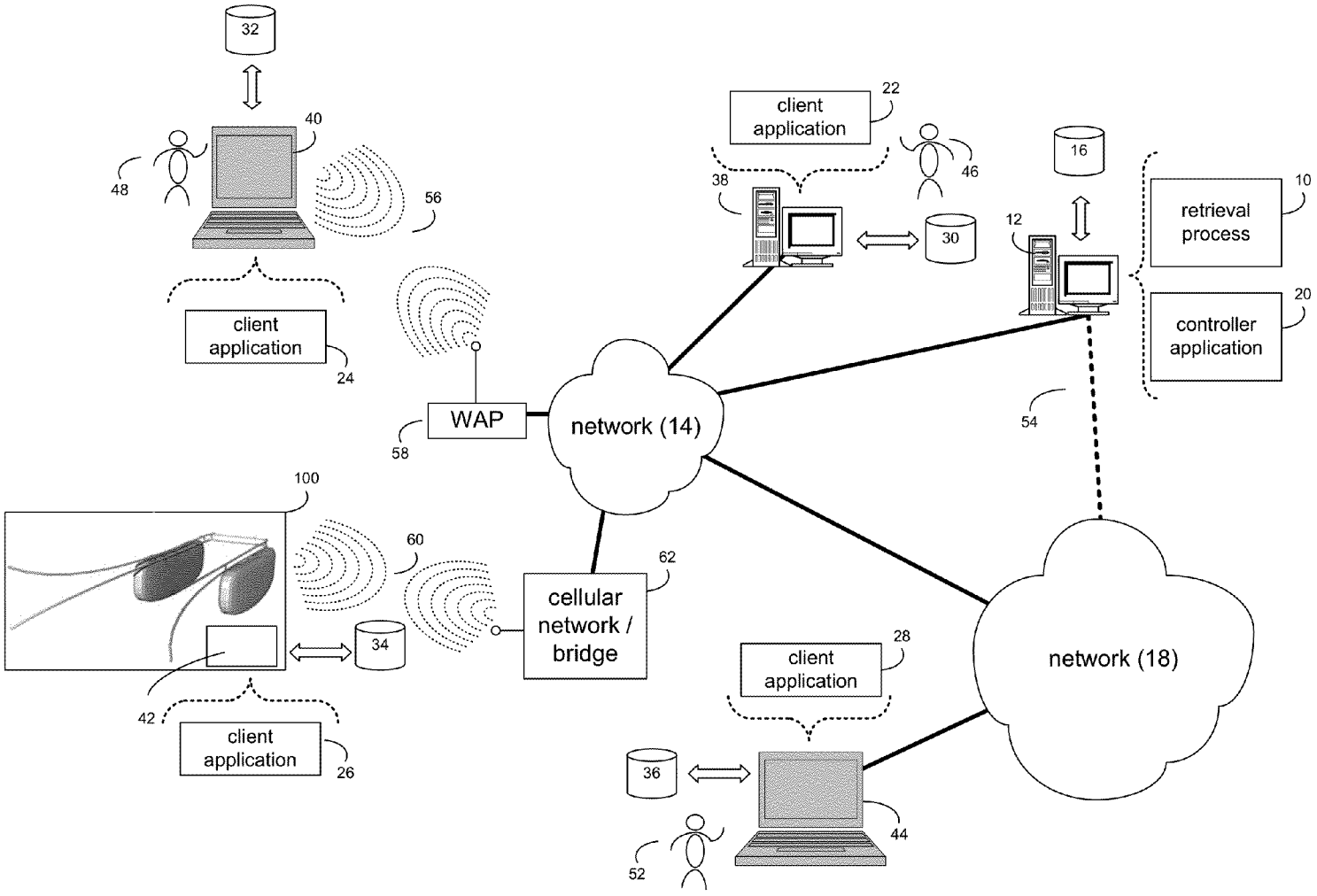
FIG. 1 is an illustrative diagrammatic view of a retrieval process coupled to a distributed computing network according to one or more implementations of the present disclosure.

As will be appreciated by one skilled in the art, the present disclosure (and/or aspects thereof) may be embodied as a method, system (e.g., apparatus), or computer program product. Accordingly, the present disclosure (and/or aspects thereof) may take the form of an entirely hardware implementation, an entirely software implementation (including firmware, resident software, micro-code, etc.) or an implementation combining software and hardware aspects that may all generally be referred to herein as a "circuit," "module" or "system." Furthermore, the present disclosure (and/or aspects thereof) may take the form of a computer program product on a computer-usable storage medium having computer-usable program code embodied in the medium.

Any suitable computer usable or computer readable medium may be utilized. The computer readable medium may be a computer readable signal medium or a computer readable storage medium. The computer-usable, or computer-readable, storage medium (including a storage device associated with a computing device or client electronic device) may be, for example, but not limited to, an electronic, magnetic, optical, electromagnetic, infrared, or semiconductor system, apparatus, device, or any suitable combination of the foregoing. More specific examples (a non-exhaustive list) of the computer-readable medium may include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a media such as those supporting the internet or an intranet, or a magnetic storage device. Note that the computer-usable or computer-readable medium could even be a suitable medium upon which the program is stored, scanned, compiled, interpreted, or otherwise processed in a suitable manner, if necessary, and then stored in a computer memory. In the context of this document, a computer-usable or computer-readable, storage medium may be any tangible medium that can contain or store a program for use by or in connection with the instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. The computer readable program code may be transmitted using any appropriate medium, including but not limited to the internet, wireline, optical fiber cable, RF, etc. A computer readable signal medium may be any computer readable medium that is not a computer readable storage medium and that can communicate, propagate, or transport a program for use by or in connection with an instruction execution system, apparatus, or device.

Computer program code for carrying out operations of the present disclosure may be written in an object oriented programming language such as Java®, Smalltalk, C++ or the like. Java and all Java-based trademarks and logos are trademarks or registered trademarks of Oracle and/or its affiliates. However, the computer program code for carrying out operations of the present disclosure may also be written in conventional procedural programming languages, such as the "C" programming language, PASCAL, or similar programming languages, as well as in scripting languages such as Javascript or PERL. The program code may execute entirely on the user's computer, partly on the user's computer, as a standalone software package, partly on the user's computer and partly on a remote computer or entirely on the remote computer or server. In the latter scenario, the remote computer may be connected to the user's computer through a local area network (LAN) or a wide area network (WAN), or the connection may be made to an external computer (for example, through the internet using an Internet Service Provider).

The block diagrams in the figures illustrate the architecture, functionality, and operation of possible implementations of apparatus (systems), methods and computer program products according to various implementations of the present disclosure. It will be understood that each block in the block diagrams, and combinations of blocks in the block diagrams, may represent a module, segment, or portion of code, which comprises one or more executable computer program instructions for implementing the specified logical/physical function (s)/act(s). These computer program instructions may be provided to a processor of a general purpose computer, special purpose computer, or other programmable data processing apparatus to produce a machine, such that the computer program instructions, which may execute via the processor of the computer or other programmable data processing apparatus, create the ability to implement one or more of the functions/acts specified in the block diagram block. It should be noted that, in some alternative implementations, the functions noted in the block(s) may occur out of the order noted in the figures. For example, two blocks shown in succession may, in fact, be executed substantially concurrently, or the blocks may sometimes be executed in the reverse order, depending upon the functionality involved.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the block diagram block.

The computer program instructions may also be loaded onto a computer or other programmable data processing apparatus to cause a series of operational steps to be performed (not necessarily in a particular order) on the computer or other programmable apparatus to produce a computer implemented process such that the instructions which execute on the computer or other programmable apparatus provide steps for implementing the functions/acts (not necessarily in a particular order) specified in the flowchart and/or block diagram block or blocks or combinations thereof.

For example, and referring at least to FIG. 1, there is shown a retrieval process 10 that may reside on and may be executed by a computer (e.g., computer 12), which may be connected to a network (e.g., network 14) (e.g., the internet or a local area network). Examples of computer 12 may include, but are not limited to, a personal computer(s), a laptop computer(s), mobile computing device(s), a server computer, a series of server computers, a mainframe computer(s), or a computing cloud(s). Computer 12 may execute an operating system, for example, but not limited to, Microsoft® Windows®; Mac® OS X®; Red Hat® Linux®, or a custom operating system. (Microsoft and Windows are registered trademarks of Microsoft Corporation in the United States, other countries or both; Mac and OS X registered trademarks of Apple Inc. in the United States, other countries or both; Red Hat is a registered trademark of Red Hat Corporation in the United States, other countries or both; and Linux is a registered trademark of Linus Torvalds in the United States, other countries or both).

As will be discussed below in greater detail, retrieval process 10 may be used at least in part, to align a first gap portion formed between at least a portion of a first and second rail coupled to a capture object (e.g., apparatus 100) with at least a portion of the target object. At least the portion of the target object may be received at the first gap portion as a distance between the first gap portion and at least the portion of the target object decreases. A second gap portion formed between at least the portion of the first and second rail may be aligned with at least the portion of the target object. At least the portion of the target object may be received at the second gap portion as a distance between the second gap portion and at least the portion of the target object decreases.

The instruction sets and subroutines of retrieval process 10, which may be stored on storage device 16 coupled to computer 12, may be executed by one or more processors (not shown) and one or more memory architectures (not shown) included within computer 12. Storage device 16 may include but is not limited to: a hard disk drive; a flash drive, a tape drive; an optical drive; a RAID array; a random access memory (RAM); and a read-only memory (ROM).

Network 14 may be connected to one or more secondary networks (e.g., network 18), examples of which may include but are not limited to: a local area network; a wide area network; or an intranet, for example.

Computer 12 may execute a controller application (e.g., controller application 20), examples of which may include, but are not limited to, e.g., any application that allows for the physical movement of an object or portions of the object (e.g., via motor, engine, thruster, actuator, etc.) remotely (e.g., wireless connection between the object and controller application) or otherwise (e.g., a physical connection between the object and controller application). Retrieval process 10 and/or controller application 20 may be accessed via client applications 22, 24, 26, 28. Retrieval process 10 may be a stand alone application, or may be an applet/application/script that may interact with and/or be executed within controller application 20. Examples of client applications 22, 24, 26, 28 may include, but are not limited to, e.g., any application that allows for the physical movement of an object or portions of the object (e.g., via motor, engine, thruster, actuator, etc.) remotely (e.g., wireless connection between the object and controller application) or otherwise (e.g., a physical connection between the object and controller application), a standard and/or mobile web browser, a textual and/or a graphical user interface, a customized web browser, a plugin, or a custom application. The instruction sets and subroutines of client applications 22, 24, 26, 28, which may be stored on storage devices 30, 32, 34, 36 coupled to client electronic devices 38, 40, 42, 44, may be executed by one or more processors (not shown) and one or more memory architectures (not shown) incorporated into client electronic devices 38, 40, 42, 44. Apparatus 100 may include, e.g., client electronic device 42, to interact with retrieval process 10 and/or controller application 20 to facilitate the above-noted physical movement of the object (e.g., apparatus 100) and/or portions of the object (e.g., rails) as will be discussed in greater detail below. As an example, a user may, e.g., via computer 12, retrieval process 10, controller application 20 or combination thereof, send instructions to client application 26 that may cause a motor and/or rudder coupled to apparatus 100 to activate, thereby moving apparatus 100 (e.g., similar to that of a boat).

Storage devices 30, 32, 34, 36 may include but are not limited to: hard disk drives; flash drives, tape drives; optical drives; RAID arrays; random access memories (RAM); and read-only memories (ROM). Examples of client electronic devices 38, 40, 42, 44 may include, but are not limited to, a personal computer (e.g., client electronic device 38), a laptop computer (e.g., client electronic device 40), a smart phone (e.g., client electronic device 42), a notebook computer (e.g., client electronic device 44), a tablet (not shown), a server (not shown), a data-enabled, cellular telephone (not shown), a television (not shown), a smart television (not shown), a media (e.g., video, photo, etc.) capturing device (not shown), and a dedicated network device (not shown). Client electronic devices 38, 40, 42, 44 may each execute an operating system, examples of which may include but are not limited to, Android™, Apple® iOS®, Mac® OS X®; Red Hat® Linux®, or a custom operating system.

One or more of client applications 22, 24, 26, 28 may be configured to effectuate some or all of the functionality of retrieval process 10 (and vice versa). Accordingly, retrieval process 10 may be a purely server-side application, a purely client-side application, or a hybrid server-side/client-side application that is cooperatively executed by one or more of client applications 22, 24, 26, 28 and retrieval process 10.

One or more of client applications 22, 24, 26, 28 may be configured to effectuate some or all of the functionality of controller application 20 (and vice versa). Accordingly, controller application 20 may be a purely server-side application, a purely client-side application, or a hybrid server-side/client-side application that is cooperatively executed by one or more of client applications 22, 24, 26, 28 and controller application 20.

Users 46, 48, 50, 52 may access computer 12 and retrieval process 10 directly through network 14 or through secondary network 18. Further, computer 12 may be connected to network 14 through secondary network 18, as illustrated with phantom link line 54. Retrieval process 10 may include one or more user interfaces, such as browsers and textual or graphical user interfaces, through which users 46, 48, 50, 52 may access retrieval process 10.

The various client electronic devices may be directly or indirectly coupled to network 14 (or network 18). For example, client electronic device 38 is shown directly coupled to network 14 via a hardwired network connection. Further, client electronic device 44 is shown directly coupled to network 18 via a hardwired network connection. Client electronic device 40 is shown wirelessly coupled to network 14 via wireless communication channel 56 established between client electronic device 40 and wireless access point (i.e., WAP) 58, which is shown directly coupled to network 14. WAP 58 may be, for example, an IEEE 802.11a, 802.11b, 802.11g, Wi-Fi, and/or Bluetooth™ device that is capable of establishing wireless communication channel 56 between client electronic device 40 and WAP 58. Client electronic device 42 is shown wirelessly coupled to network 14 via wireless communication channel 60 established between client electronic device 42 and cellular network/bridge 62, which is shown directly coupled to network 14.

Some or all of the IEEE 802.11x specifications may use Ethernet protocol and carrier sense multiple access with collision avoidance (i.e., CSMA/CA) for path sharing. The various 802.11x specifications may use phase-shift keying (i.e., PSK) modulation or complementary code keying (i.e., CCK) modulation, for example. Bluetooth™ is a telecommunications industry specification that allows, e.g., mobile phones, computers, smart phones, and other electronic devices to be interconnected using a short-range wireless connection.

Figure 2:
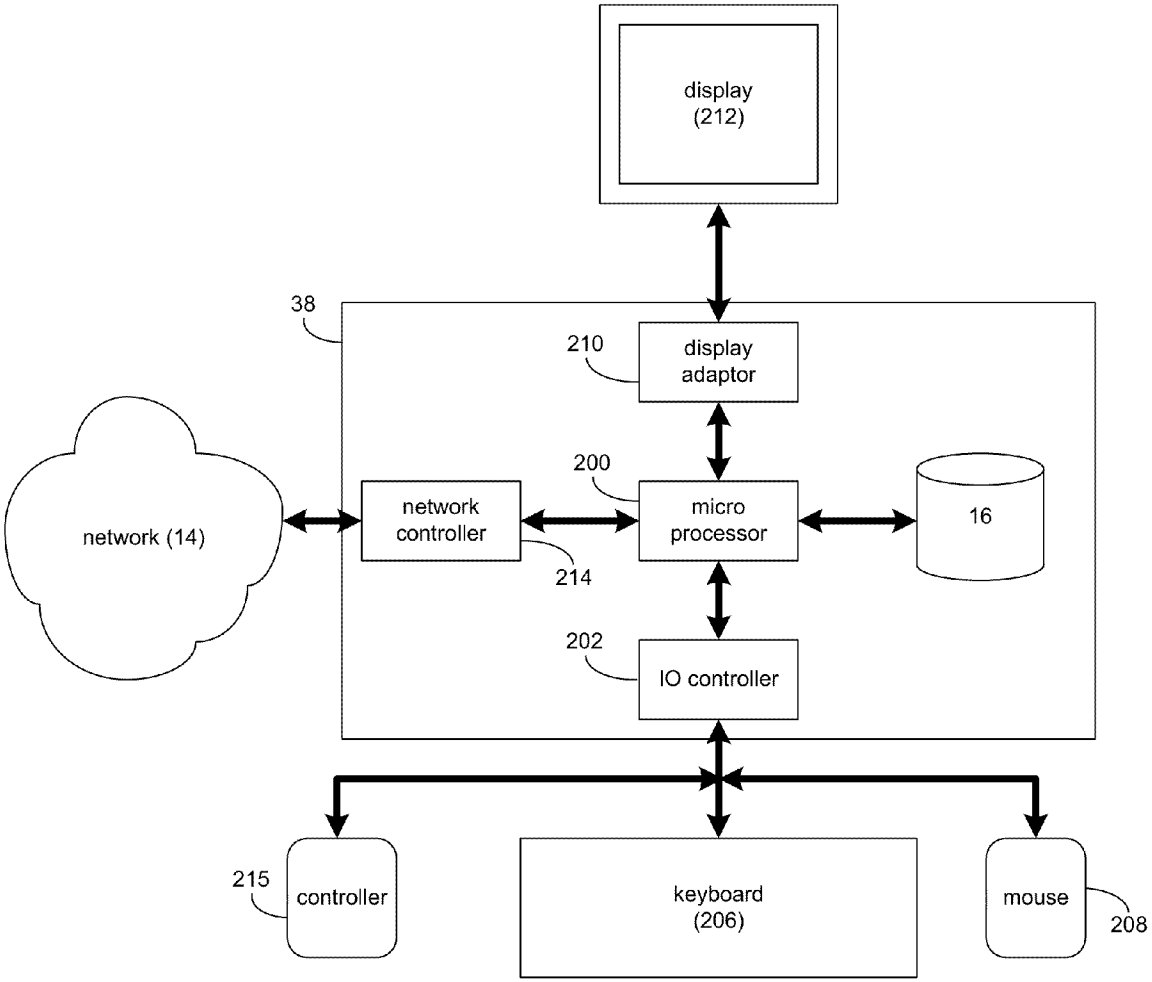
FIG. 2 is a diagrammatic view of a client electronic device of FIG. 1 according to one or more implementations of the present disclosure.
Figure 3:
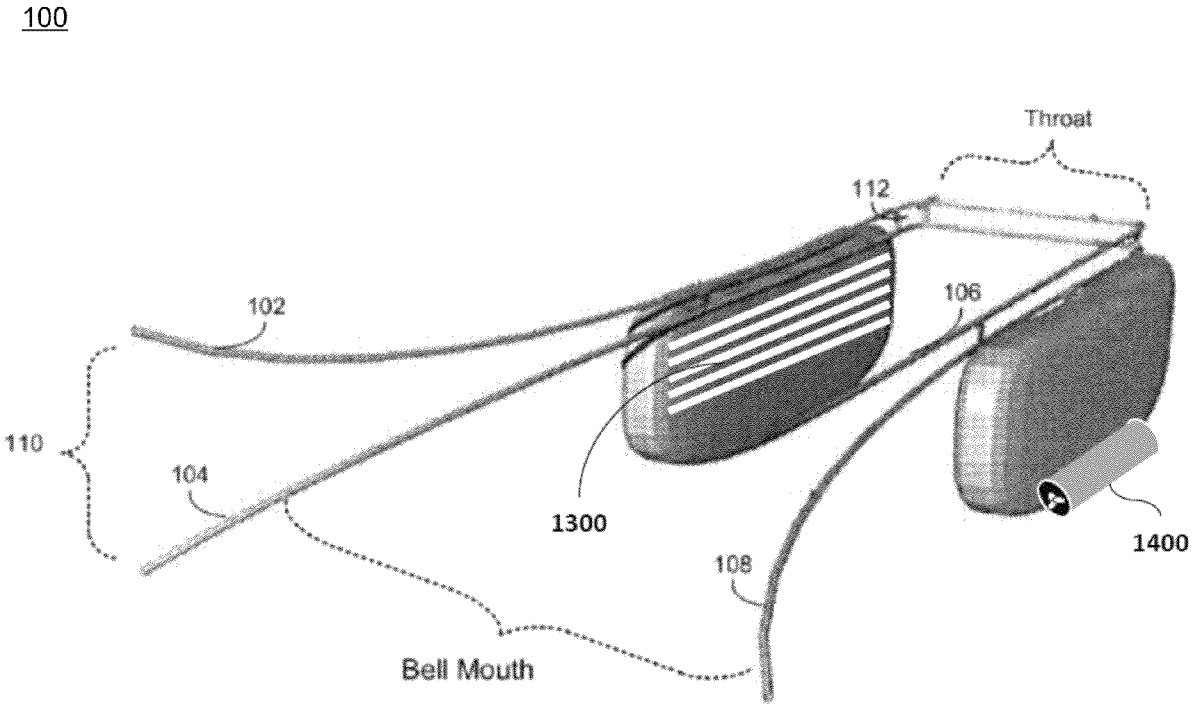
FIG. 3 is an illustrative diagrammatic view of an apparatus according to one or more implementations of the present disclosure.
Figure 4:
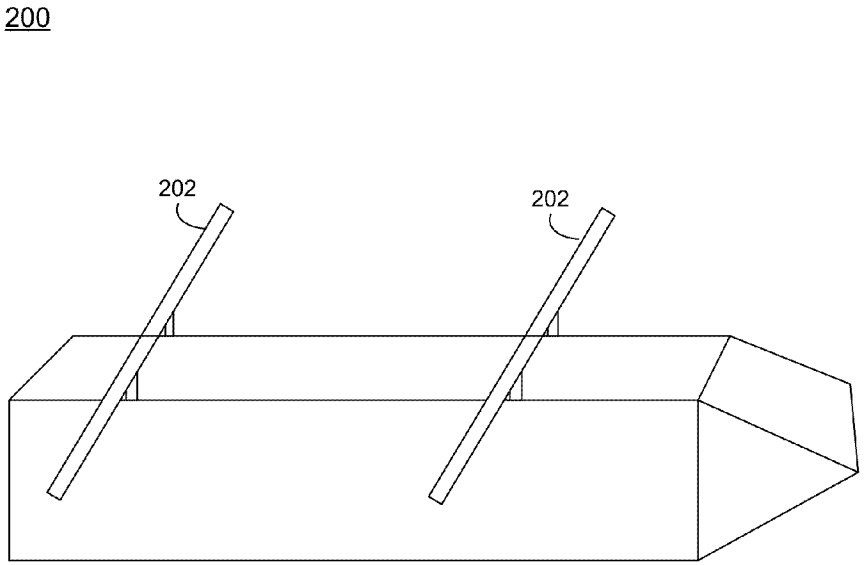
FIG. 4 is an illustrative diagrammatic view of a vessel according to one or more implementations of the present disclosure.

Referring also to FIG. 2, there is shown a diagrammatic view of client electronic device 38. While client electronic device 38 is shown in this figure, this is for illustrative purposes only and is not intended to be a limitation of this disclosure, as other configuration are possible. For example, any computing device capable of executing, in whole or in part, retrieval process 10 may be substituted for client electronic device 38 within FIG. 2, examples of which may include but are not limited to computer 12 and/or client electronic devices 40, 42, 44.

Client electronic device 38 may include a processor and/or microprocessor (e.g., microprocessor 200) configured to, e.g., process data and execute the above-noted code/instruction sets and subroutines. Microprocessor 200 may be coupled via a storage adaptor (not shown) to the above-noted storage device 16. An I/O controller (e.g., I/O controller 202) may be configured to couple microprocessor 200 with various devices, such as keyboard 206, pointing/selecting device (e.g., mouse 208), custom device (e.g., controller 215), USB ports (not shown), and printer ports (not shown). A display adaptor (e.g., display adaptor 210) may be configured to couple display 212 (e.g., CRT or LCD monitor(s)) with microprocessor 200, while network controller/adaptor 214 (e.g., an Ethernet adaptor) may be configured to couple microprocessor 200 to the above-noted network 14 (e.g., the Internet or a local area network).

As will be discussed in greater detail below, in some implementations, a capture object (e.g., apparatus 100, vessel, structure, etc.) may utilize, for example, environment normalization techniques to, e.g., reduce the varying displacements and the response time between apparatus 100 and the target object (e.g., robotic container, "sea truck", vessel, Unmanned Underwater Vessel (UUV), Rigid Hull Inflatable Boats (RHIBs), etc.). Apparatus 100 and target object may share a common (e.g., similar) environment, such as the air, the surface of the water, and under the surface of the water. Apparatus 100 and target object may both exhibit similar dynamic characteristics due to, e.g., the above-noted common environment, as well as their similar relative size when compared to apparatus 100. In some implementations, apparatus 100 may enable successful retrieval of the target object, at least in part, e.g., by allowing mechanical structural members to align a "capture bar" or other structural member on the target object with the "throat" of apparatus 100. In some implementations, this may ensure incremental, self-aligning (and/or controlled aligning), and secure positive control of the target object.

As will also be discussed in greater detail below, in some implementations, apparatus 100 may be deployed to both launch and/or capture (e.g., recover) the above-noted target objects from, e.g., other (larger) vessels (e.g., ships) in the water, hovering aircraft (e.g., helicopter, blimp, etc.), or stationary platforms (e.g., oil drilling rigs, piers, dams, other fixed/tethered platforms, etc.).

For instance, in some implementations, apparatus 100 may launch and/or recover a target object onto and/or off of a (large) ship. In the example, the target object may be captured by apparatus 100 while on a parallel path alongside the ship, utilizing, e.g., a deployed bollard, to help keep apparatus 100 in a "fixed" position relative to the ship, while allowing apparatus 100 freedom of motion in pitch, roll, and heave. This may simplify the connection with the target object. The bollard technique may also provide the ability to capture "dead in the water" target objects (e.g., objects unable to move due to steering and/or engine failure or general lack of ability) that may be in a parallel path relative to apparatus 100. In some implementations, apparatus 100 may be aligned facing into the water stream and the large ship may provide the mobility to come along side the dead in the water target object that may be "scooped" into the rails.

In some implementations, apparatus 100 may be towed aft of the large ship and may accomplish an "in-stream" recovery away from the large ship. As will be discussed in greater detail below, apparatus 100 may be "motorized" allowing apparatus 100 to "seek out" target objects that may be stationary in the water and effect to connection. In some implementations, the ship may be moving and align the capture device within a margin of error to the target object and the motion of the ship may capture the target object. In some implementations, the large ship's speed may be increased/decreased to match the target object's "beat steerage speed" (e.g., the speed that allows the most steering and handling control for close operations). Error reduction may allow a positive connection and hence create a better chance for recovery in the first attempt. Many sea state conditions, combat operations, life saving events, etc., may not allow a second attempt.

In some implementations, and continuing with the above example, assume for illustrative purposes only that the ship is anchored or "dead in the water". In the example, the actual hull of the ship may be used to ensure that apparatus 100 remains stationary at the time of engagement (e.g., when apparatus 100 is aligning and receiving the target object). In the example, apparatus 100 may but need not be parallel with the centerline of the ship, and may but need not be in an orientation that may allow apparatus 100 to rest against the hull of the ship during capturing. In some implementations, apparatus 100 may be used in the trail position on the ship. In the example, the overhead lifting device (e.g., crane) may include tethers to maintain apparatus 100's alignment aft of the ship, and utilize the stern structure of the ship to maintain, e.g., the longitudinal position of apparatus 100 when capturing the target object. In some implementations, the hull of the ship or the design of the bollard may pose an interference with the target vessel structure. In the example, one or more ballasting bumpers may be added to, e.g., the end of apparatus 100 or elsewhere, e.g., to reduce damage via the target object.

In some implementations, the capture device may also launch small target objects from the ship. For example, from the ship (e.g., within, on top of, etc.), the target object may be inserted within apparatus 100 any may include one or more latches to secure the target object to apparatus 100. Apparatus 100 may then place the target object into, e.g., the water, or other location. Once placed into the water, the one or more latches may be released to allow the target object to exit apparatus 100 relatively freely. As noted above, apparatus 100 may be scaled to capture other target objects and/or be utilized from other objects, such as a helicopter and other aircraft retrieval (e.g., blimp, hovering aircraft (e.g., V-22), etc.), etc.

As discussed above, and as will be discussed in greater detail below, and referring also to FIGS. 3-14, retrieval process 10 may (e.g., via controller application 20, controller 215, client application 26, or combination thereof) align a first gap portion formed between at least a portion of a first and second rail coupled to a capture object with at least a portion of the target object. At least the portion of the target object may be received at the first gap portion as a distance between the first gap portion and at least the portion of the target object decreases. A second gap portion formed between at least the portion of the first and second rail may be aligned by retrieval process 10 with at least the portion of the target object. At least the portion of the target object may be received at the second gap portion as a distance between the second gap portion and at least the portion of the target object decreases.

As will also be discussed in greater detail below, aligning at least one of the first and second gap portion may include retrieval process 10 (e.g., via controller application 20, controller 215, client application 26, or combination thereof) stabilizing at least one of the first and second rail using one or more ballasts. At least one of the first and second rail may be dynamically stabilized by retrieval process 10 (e.g., via controller application 20, controller 215, client application 26, or combination thereof) via, at least in part, the one or more ballasts. Aligning at least one of the first and second gap portion may include at least one of extending and retracting at least one of the first and second rail by retrieval process 10 (e.g., via controller application 20, controller 215, client application 26, or combination thereof). Aligning at least one of the first and second gap portion may include retrieval process 10 (e.g., via controller application 20, controller 215, client application 26, or combination thereof) navigating at least one of the first and second rail via at least one of a motor, an engine, and a thruster. At least the portion of the target object may be prevented by retrieval process 10 (e.g., via controller application 20, controller 215, client application 26, or combination thereof) from moving in one or more directions via a catch after at least the portion of the target object is proximate to the catch. At least the portion of the target object may be lifted by retrieval process 10 (e.g., via controller application 20, controller 215, client application 26, or combination thereof) in a vertical direction after at least one of the first and second gap portion is aligned and received.

In some implementations, an apparatus (e.g., apparatus 100) may be configured to capture a target object from, e.g., a body of water or other location. Apparatus 100 may comprise a first rail (e.g., rail 102) and a second rail (e.g., rail 104), where first rail 102 may be proximate to second rail 104. In some implementations, the term "rail" need not imply any particular shape and/or material. For example, at least one of the rails (e.g., rail 102) may but need not be rounded and/or elongated in shape. As another example, at least one of the rails may include at least one of a straight and a curved shape, such as shown in example FIG. 3. Any degree of curvature may be included without departing from the scope of the disclosure. Other shapes and configurations may also apply without departing from the scope of the disclosure. Additionally, rail 102 may include materials such as steel, or any other material capable of performing any of the functions disclosed herein.

In some implementations, other rails may be included, such as a third rail (e.g., rail 106) and a fourth rail (e.g., rail 108). In some implementations, only a single rail may be used. As such, the description of two rails should be taken as an example only and not to limit the scope of the disclosure. In some implementations, reference to rail 102 may apply equally to any of rail 104, 106, and/or 108, and vice versa as appropriate.

In some implementations, apparatus 100 may include another example gap (e.g., a "mouth", "bell mouth", etc.) and yet another example gap (e.g., "throat"). It will be appreciate that the usage of the terms "mouth", "bell mouth", "throat", etc. may but need not imply a particular shape or design and may be used merely to help illustrate one or more implementations of the disclosure.

In some implementations, a first gap portion (e.g., gap portion 110) may be formed between at least a portion of rail 102 and rail 104. Gap portion 110 may be configured to align and receive at least a portion of the target object as a distance between gap portion 106 and at least the portion of the target object decreases. In some implementations, a second gap portion (e.g., gap portion 112) may be formed between at least the portion of rail 102 and rail 104. In some implementations, rail 102 and rail 104 may be further configured to align and receive at least the portion of the target object with gap portion 112 as the distance between gap portion 112 and at least the portion of the target object decreases.

For instance, assume for example purposes only that the target object includes a vessel (e.g., vessel 200). Further assume that at least a portion of vessel 200 includes, e.g., a "lifting bar", such as lifting bar(s) 202. In some implementations, the term "bar" need not imply any particular shape and/or material. For example, at least one of the rails (e.g., lifting bars 202) may but need not be rounded and/or elongated in shape; however, other shapes and configurations may also apply without departing from the scope of the disclosure. Additionally, lifting bars 202 may include materials such as steel, or any other material capable of performing any of the functions disclosed herein. In some implementations, lifting bars 202 may include a set of one or more horizontal bars that may be temporarily or permanently secured across vessel 200 using any known techniques (e.g., welding, bolting, etc.).

Figure 5:
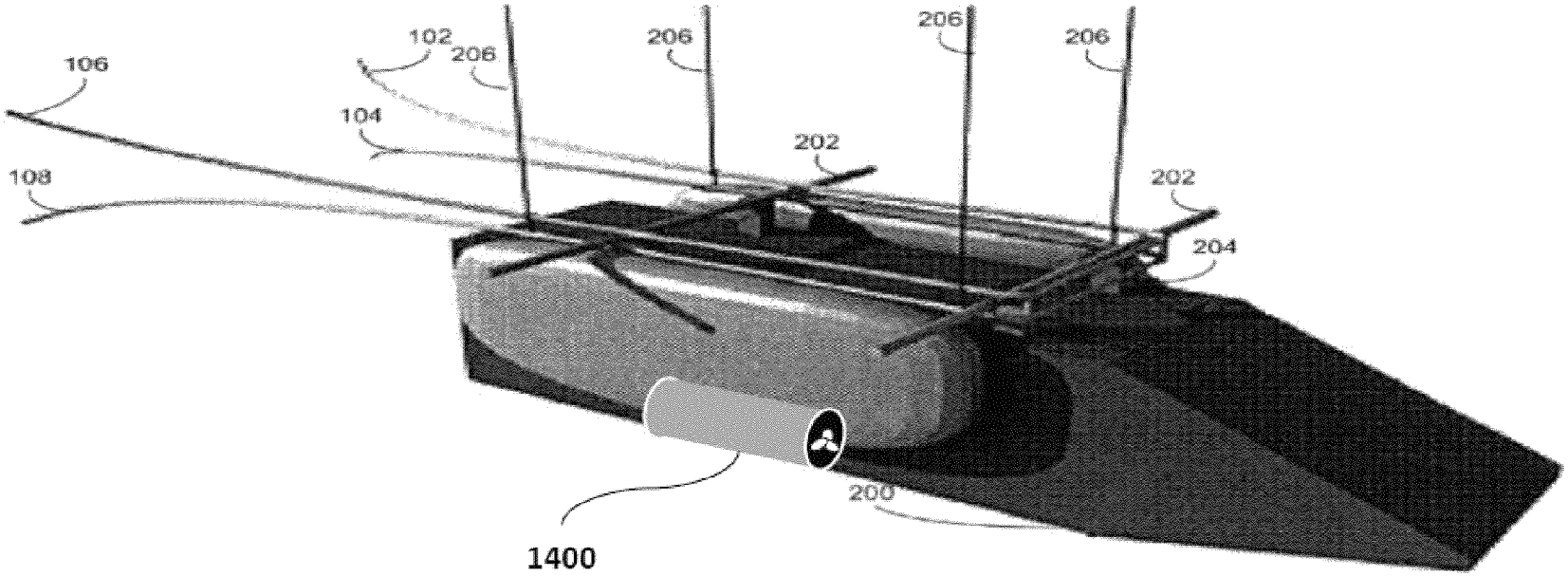
FIG. 5 is an illustrative diagrammatic view of an apparatus with a received vessel according to one or more implementations of the present disclosure.

Lifting bars 202 may be aligned and received into the bell mouth (e.g., via gap portion 110 as the distance between gap portion 110 and lifting bars 202 of vessel 200 decreases) and into the throat of apparatus 100 (e.g., via gap portion 112 as the distance between gap portion 112 and lifting bars 202 of vessel 200 decreases). An example of lifting bars 202 after being aligned and received is illustrated at FIG. 5. In FIG. 5, lifting bars 202 have been aligned and received between gap portion 110 of rail 102 and rail 104 and between gap portion 112 of rail 106 and rail 108.

In some implementations, as noted above, one or more stabilizing portions may be configured to stabilize at least rail 102 and/or rail 104. For example, the one or more stabilizing portions may include one or more portions (e.g., of apparatus 100) configured to receive one or more cables operatively connected to, e.g., a crane. For instance, at least a portion of apparatus 100 (e.g., rail 102 and/or rail 104 and/or rail 106 and/or 108, etc.) may be temporarily or permanently coupled using any known techniques to, e.g., a cable (e.g., crane cable 206), such that vessel 200 may be lifted or otherwise moved via lifting bars 202. It will be appreciated that any technique (cable or otherwise) may be used without departing from the scope of the disclosure. In some implementations, for example, where vessel 200 may have designated lift points, lifting tethers 204 (or other lifting systems) from one or more lifting bars 202 to the lifting points may be utilized, e.g., to take the load off of lifting bars 202 and onto the designated lifting points. It will be appreciated that scalability may also effect the number of lift points (e.g., a single lift point vs. multiple lift points), as well as the lift capability of above-noted large vessel.

In some implementations, the dimensions of the bell mouth may be determined based upon, at least in part, the anticipated dynamic roll, pitch, etc. of vessel 200 (and lifting bars 202). For instance, assume for example purposes only that vessel 200 is +/−10 degrees roll and +/−10 degrees pitch. In the example, the vertical ends of the bell mouth may be aligned (e.g., adjusted), e.g., to ensure that lifting bars 202 may be received (e.g., captured), as well as the offset in riding heights, e.g., to ensure positive engagement between apparatus 100 and lifting bars 202 (via vessel 200). In some implementations, the scale of the vertical opening on the bell mouth may be reduced, as both apparatus 100 and lifting bars 202 (via vessel 200) may share a common environment (e.g., at, near, and/or below the surface of the water). In the example, the vertical opening in the bell mouth may but need not be proportional to the wave height and/or swells, but to the combination of residual dynamic motions of pitch and roll coupled in lifting bars 202 (via vessel 200).

In some implementations, and referring at least to FIGS. 3, 5, 7 and 11, at least one of a motor, an engine, and a thruster (e.g., thruster 1400) may be configured to navigate at least one above-noted rails (e.g., rails 102 and rails 104). For example, aligning and/or receiving vessel 200 (and thus lifting bars 202) may include controlling the motion (e.g., lateral, forward, backward, up, down, etc.) of apparatus 100 (and thus rail 102 and rail 104) and/or rail 102 and rail 104 separately from apparatus 100. The motion may be controlled (e.g., automatically and/or manually via controller 215, retrieval process 10, controller application 20, controller 215, client application 26, or combination thereof), to align and receive lifting bars 202 of vessel 200 via gap portion 110 and/or gap portion 112. In some implementations, similarly as noted above, motion (e.g., lateral, forward, backward, up, down, etc.) of vessel 200 may be controlled (e.g., automatically and/or manually via controller 215) to align and receive lifting bars 202 of vessel 200 via gap portion 110 and/or gap portion 112 using any of the techniques described throughout.

In some implementations, alignment (e.g., control) of either apparatus 100 and/or vessel 200 may include, e.g., an alignment laser, RF link, emitters, etc., around the opening of the mouth (e.g., on the above-noted large vessel and/or apparatus 100 and/or vessel 200) such that low visibility utilization and nighttime alignment and capture may be achieved. In some implementations, the above-noted larger vessel may take over manual control of vessel 200 to align and receive vessel 200 at apparatus 100. Any of the above-noted communication links may be established between vessel 200 and apparatus 100 to provide the information for apparatus 100 to manually and/or dynamically (e.g., automatically) adjust according to, e.g., the list and height characteristics of vessel 200. In some implementations, any of the manual and/or dynamic features described throughout may also be accomplished via the above-noted communication links established between vessel 200 and apparatus 100 to provide the information for apparatus 100 to manually and/or automatically align (e.g., adjust) and/or receive lifting bars 202 of vessel 200 via gap portion 110 and/or gap portion 112.

In some implementations, the lateral opening of the bell mouth, as shown in example FIGS. 6A and 6B, may be scaled to match the controllability/seakeeping capabilities of vessel 200 beyond the maximum width of vessel 200. For example, they may be based upon, at least in part, any traditional linkage between pitch, roll, heave, yaw, etc. and the directional command and control built into vessel 200 (if any). This may vary according to, e.g., the propulsion/steering system (if any as described above) selected for vessel 200 (and/or apparatus 100). For instance, if vessel 200 includes one or more thrusters on the bow, the lateral scale of the bell mouth may be adjusted (e.g., reduced). As another example, if vessel 200 uses a single pump jet for propulsion and steerage, the lateral dimension may be adjusted (e.g., increased), e.g., due to the reduced yaw control that system may provide. As another example, if the propulsion system uses dual thrusters/azipods, the width of apparatus 100 may be adjusted (e.g., reduced). In some implementations, the dimensions may be determined based upon, at least in part, the location on the above-noted larger vessel where the retrieval of vessel 200 may be attempted. For example, if on the leeside of the large vessel that may be maintaining minimum steerage (if any), the dimensions may be adjusted (e.g., reduced). As another example, if it is athwart vessel, the cross seas may require the dimensions to be adjusted (e.g., increased), due to, e.g., wave action at the time of contact (e.g., at the time of receiving lifting bars 202). The dimensions of apparatus may be scalable, e.g., to match the dimensions of lifting bars 202 and/or vessel 200 and the associated weight requirements. In some implementations, the support between any of the above-noted rails may be designed to not impede vessel 200 (personnel on top of vessel 200, antennas, the upper section of vessel 200, etc.) as it moves into the above-noted throat.

Figure 8:
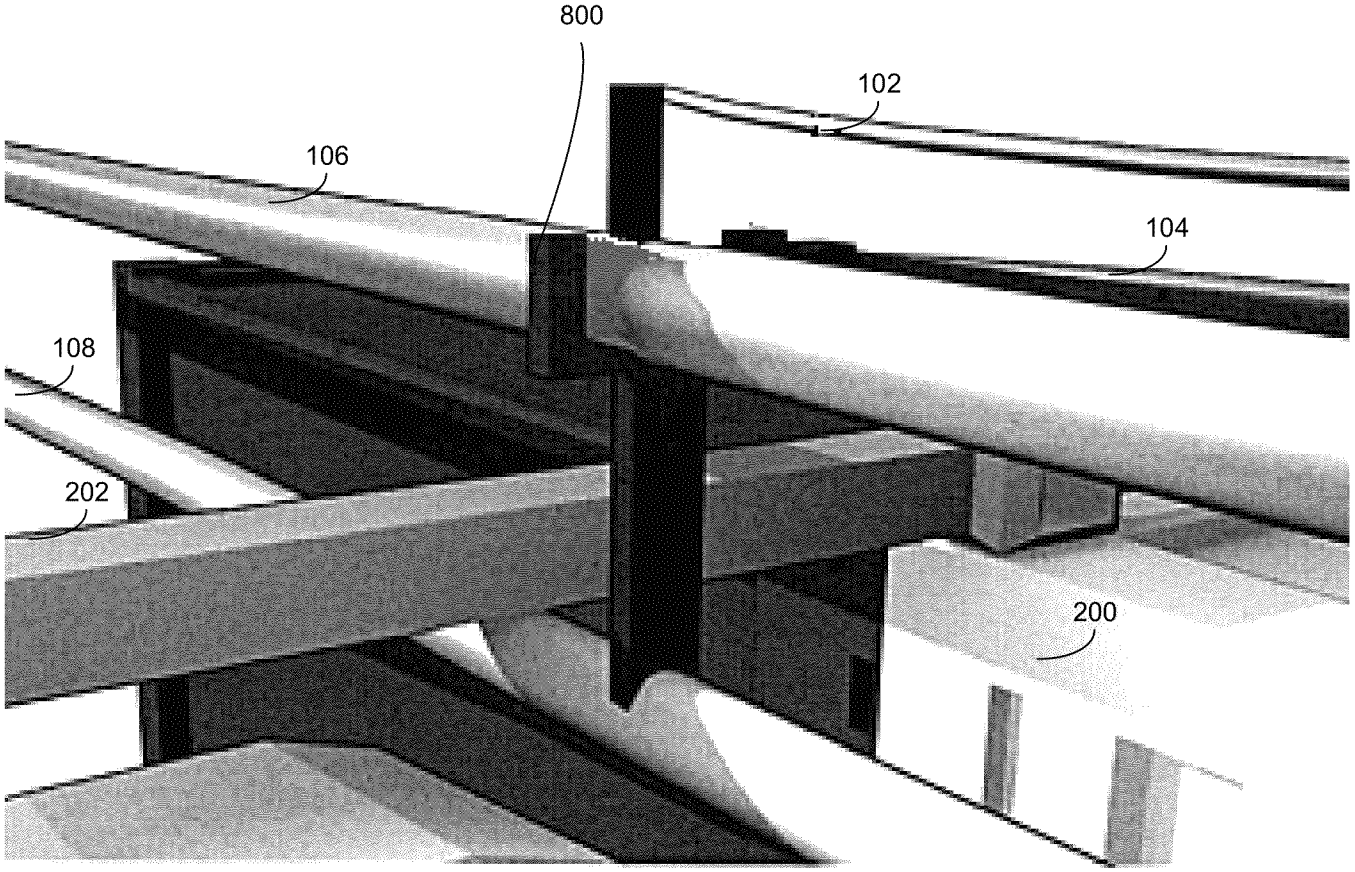
FIG. 8 is an illustrative diagrammatic view of an apparatus with a received vessel according to one or more implementations of the present disclosure.
Figure 9:
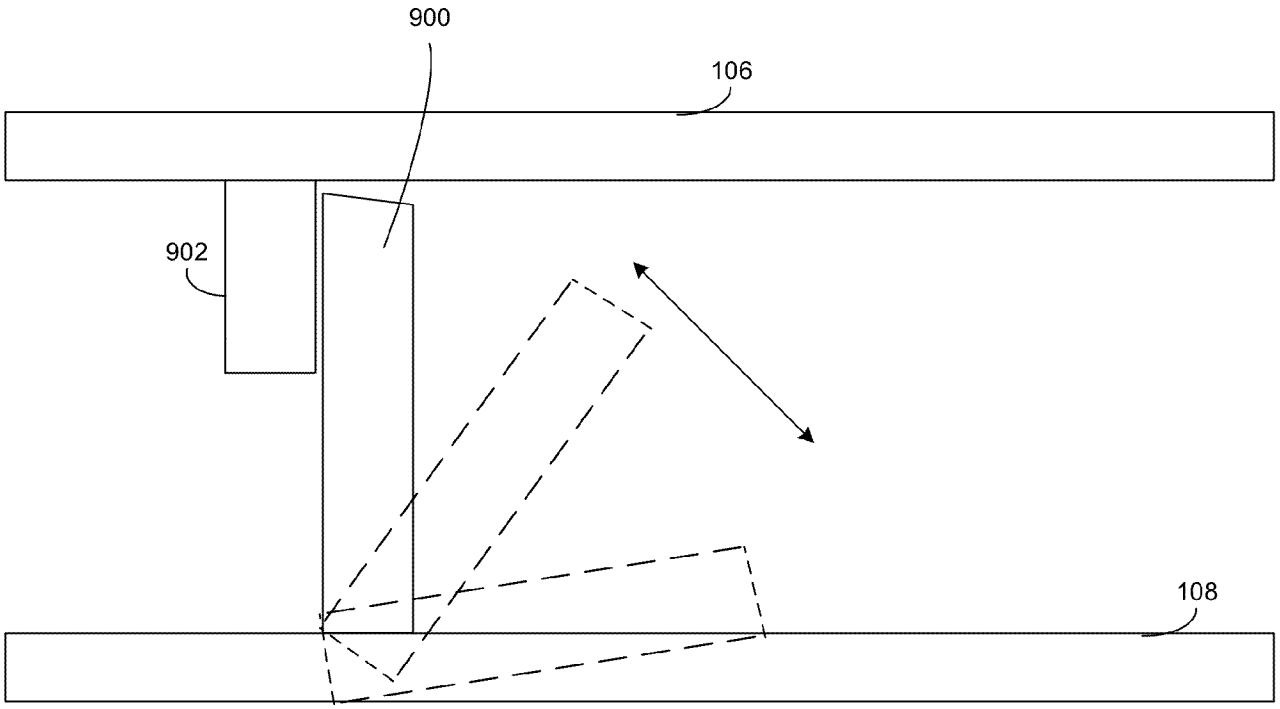
FIG. 9 is an illustrative diagrammatic view of an apparatus according to one or more implementations of the present disclosure.

In some implementations, at least one of rail 102 and rail 104 may be further configured to extend and retract. For example, and referring at least to FIGS. 6A and 6B, the width of any portion of apparatus 100 (e.g., bell mouth, throat, rails, etc.) may be adjustably aligned using, e.g., any known electro and/or mechanical devices (e.g., worm drive, screw jack, hinge, etc.), allowing apparatus 100 to be applicable for a variety of target vessels, in a variety of environmental conditions. In other implementations, the bell mouth may be adjusted to vary in width to take into account the controllability of vessel 200. This could be done using, e.g., any known electro and/or mechanical devices, such as hinges, telescoping, etc. For example, a light weight target vessel may exhibit a wide variation in its pitch and yaw during elevated sea states depending on, e.g., the direction of the waves (similar to what is shown at FIG. 8 and is known as a "Dutch roll". In the example, a greater opening in the bell mouth of apparatus 100 may be used, e.g., to increase capture probabilities. Additionally, in some implementations, a target vessel with a steering/engine casualty (or general lack of ability) may have limited ability to its directionality control. It will be appreciated that any of the adjustments described throughout may be made automatically and/or manually via a user, e.g., via controller 215, retrieval process 10, controller application 20, controller 215, client application 26, or combination thereof.

As noted above, one or more stabilizing portions may be configured to stabilize at least rail 102 and/or rail 104 (and/or rail 106 and/or rail 108). In some implementations, as another example, the one or more stabilizing portions may include one or more ballasts (e.g., ballasts 700). For instance, apparatus 100 may include a ballasting system as a floating system (e.g., as ballasts 700) and/or in addition to a flotation system. As an example, and in some implementations, ballasts 700 may be configured to dynamically stabilize rail 102 and/or rail 104 (and/or rail 106 and/or rail 108). For instance, and referring to example FIG. 7, to aid in aligning and receiving the above-noted rails with the above-noted lifting bars 202, the ballast system may use, e.g., a pump system, to import and export air, water, or another liquid to and from the ballast system to align (e.g., adjust) the height of one or more sides of apparatus 100 (and thus rails 102 and/or rail 104) to receive lifting bars 202. For example, the ballast feature may (e.g., automatically and/or manually via controller 215, retrieval process 10, controller application 20, controller 215, client application 26, or combination thereof) allow for alignment (e.g., adjustment) of the height above and below the surface (e.g., water). As another example, the ballast feature may reduce alignment displacement with vessel 200 (and thus lifting bars 202) being received and/or launched.

As another example, the ballast feature may be used asymmetrically, e.g., to create a list in apparatus 100. For instance, creating a list in apparatus 100 may be used, e.g., if vessel 200 (and thus lifting bars 202) is riding at a list, to reduce the variability that may be necessary in the bell mouth. For example, with knowledge that vessel 200 is listing (e.g., from human observation and/or via the above-noted communication link used as an input to controller 215, apparatus 100 may reduce and/or increase buoyancy on one or more sides of apparatus 100, e.g., to allow it to "complement" the list of vessel 200 and further reducing apparatus 100/vessel 200 displacements at the throat of apparatus 100. In some implementations, at least a portion of the ballast system (e.g., the inner surface of the ballast system) may act as a bumper, e.g., to reduce impact forces between apparatus 100 and vessel 200 when apparatus 100 receives vessel 200. In some implementations, the bumper may be detachable, e.g., to allow vessel 200 to exit apparatus 100 via either end and/or side.

Figure 7:
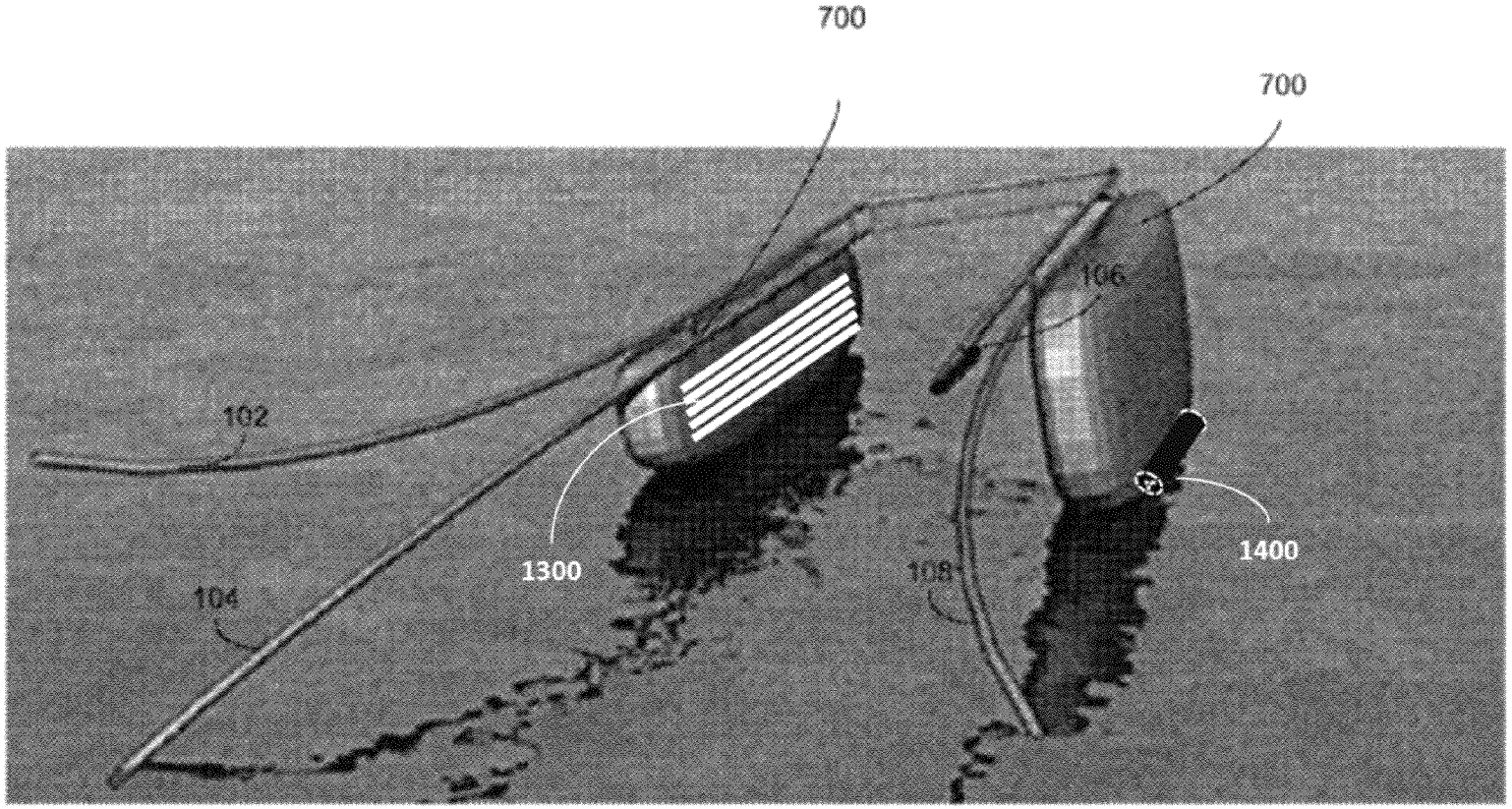
FIG. 7 is an illustrative diagrammatic view of an apparatus according to one or more implementations of the present disclosure.

In some implementations, and referring at least to FIG. 7, ballasts 700 may include one or more structures on the water as well as structures underwater to provide ballast and subdued apparatus 100 reactions (e.g., alignment) through interfacing with the water. For instance, in some implementations, ballasts 700 may include a cylinder (e.g., a cylindrical shape) with one or more optional slots (e.g., slots 1300). The slots may continue through ballasts 700 or the slots may only continue through a portion of ballasts 700 (e.g., ¾ of the way through ballasts 700). In the example, the encircled water mass within the underwater cylinder of ballasts 700 may provide a dampening effect on apparatus 100.

In some implementations, a catch may be configured to, after at least the portion of vessel 200 (e.g., lifting bars 202) is proximate to the catch, prevent at least lifting bars 202 from moving in one or more directions. For example, and referring at least to FIG. 8, one or more catches (e.g., latch 800), may be used, e.g., to control vessel 200 once lifting bars 202 are received by gap portion 110 and/or gap portion 112. In some implementations, latch 800 may be designed with structural support in tension and/or compression, and may but need not hang up on lifting bar 202 when latch 800 is fully compressed. An example of a latch (e.g., latch 900) being compressed may be shown at FIG. 9. In the example, apparatus 100 (e.g., via rail 106) may include a backstop 902 to prevent lifting bar 202 from exiting apparatus 100 after being aligned and received in gap portion 110 and/or gap portion 112 and may be similar to that of a carabineer configuration. The term "latch" may but need not imply any particular configuration and/or material.

Referring once again to FIG. 8, an example design of latch 800 is shown. In the example, latch 800 may go around rail 106 and/or rail 108 and may provide support in both tension and compression. In some implementations, when latch 800 is laying down flat, latch 800 may not interfere with lifting bar 202. Latch 800 may be temporarily and/or permanently coupled to, e.g., any portion of apparatus 100 (e.g., rail 106 and rail 108) and/or similarly to any portion of vessel 200 (e.g., lifting bar 202).

In some implementations, latch 800 may be controlled (e.g., automatically and/or manually via controller 215, retrieval process 10, controller application 20, controller 215, client application 26, or combination thereof) from the above-noted larger vessel. Latch 800 may release mechanically, e.g., to allow vessel 200 to back out, and/or the above-noted width adjustment of the throat/mouth of apparatus 100 may have sufficient capability to widen and release rail 106 and/or rail 108. It will be appreciated that other configurations of latch 800 may be used without departing from the scope of the disclosure.

In some implementations, apparatus 100 and/or latch 800 may include 3 latches per rail (e.g., 2 capture latches and one release latch) that may allow vessel 200 to leave control of apparatus 100, e.g., when there is enough space to exit forward out of apparatus 100. In some implementations, latch 800 may include one or more sensors (not shown) in front of the first two latches that may require both to be actuated for the first two latches to open. This may, e.g., prevent vessel 200 from being received on the side where only one of the latches may be actuated. In some implementations, this situation may occur with the sensors in place such that apparatus 100 may act as a bumper to protect the above-noted large vessel from possible damage. The sensors may be operatively connected to controller 215, retrieval process 10, controller application 20, client application 26, or combination thereof.

In some implementations, apparatus 100 may be designed to be collapsible and/or foldable for ready storage. For example, apparatus 100 may be designed such that it may fold into, e.g., the footprint of an ISO standard twenty foot equivalent unit (TEU) for intermodal handling, stacking utilizing standard ISO connectors, and stowage singularly or as a stack.

Figure 10:
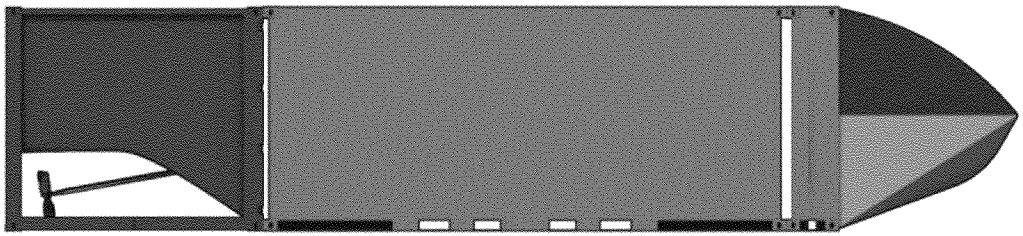
FIG. 10 is an illustrative diagrammatic view of a vessel according to one or more implementations of the present disclosure.
Figure 11:
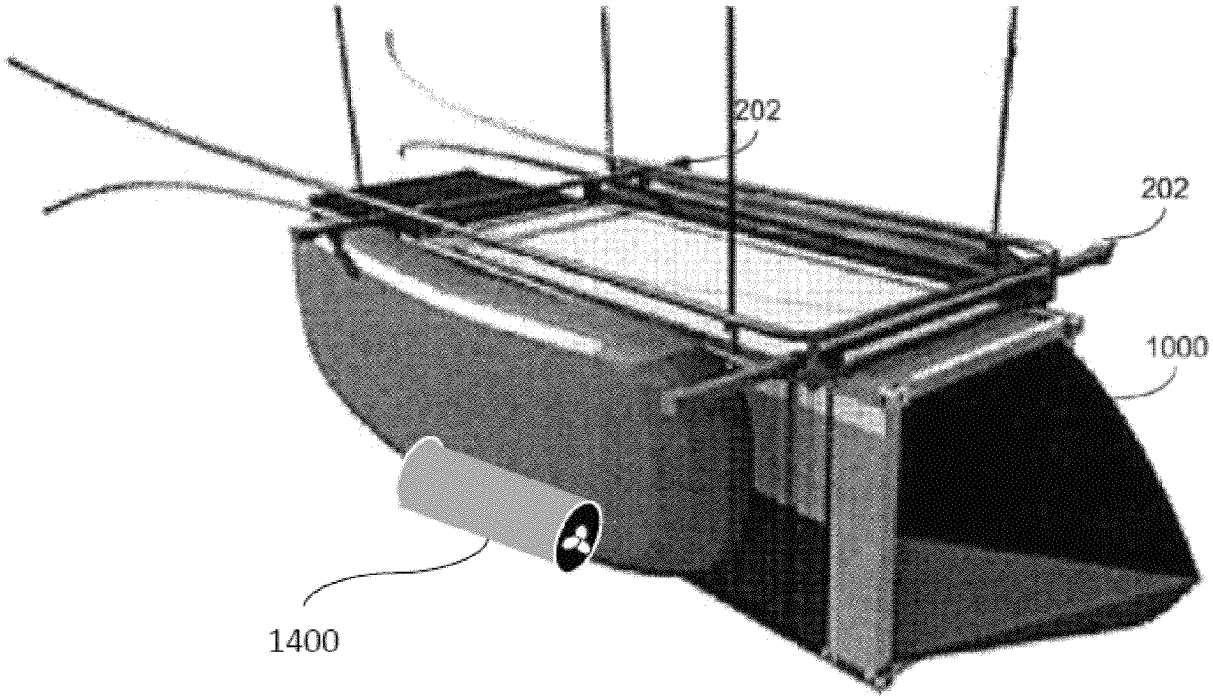
FIG. 11 is an illustrative diagrammatic view of an apparatus with a received vessel according to one or more implementations of the present disclosure.
Figure 12:
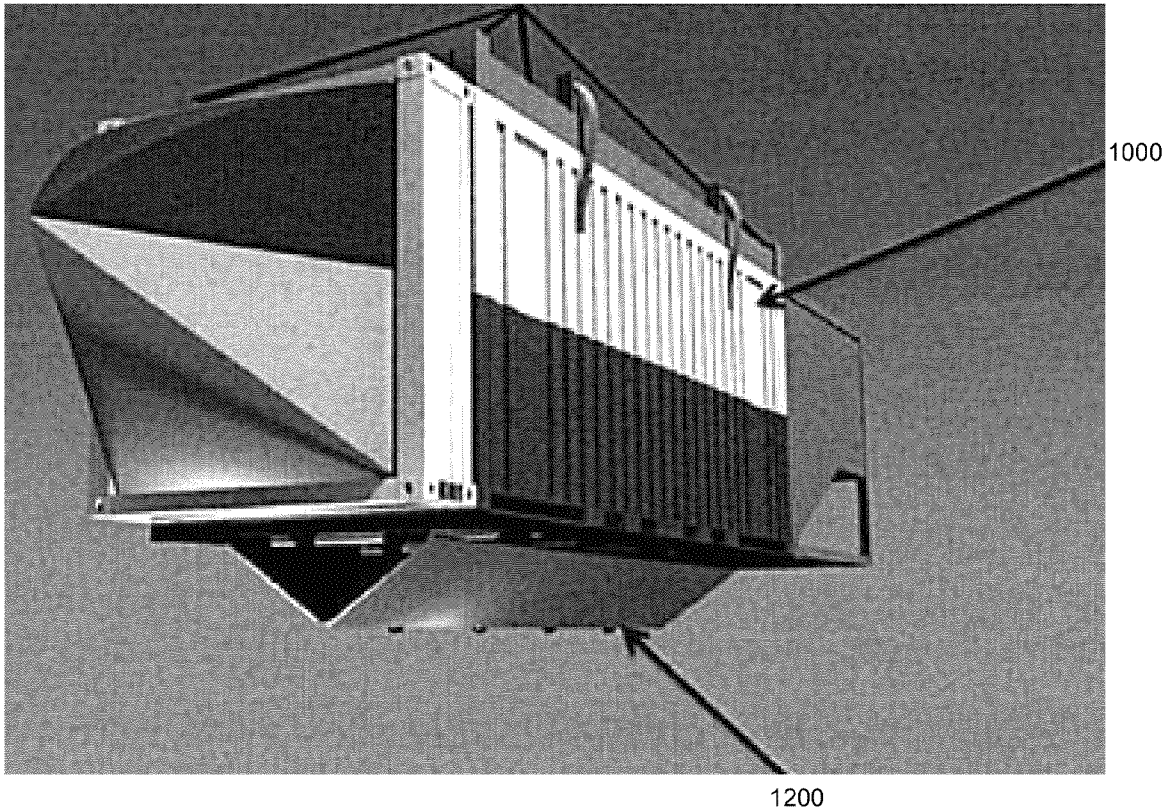
FIG. 12 is an illustrative diagrammatic view of a vessel according to one or more implementations of the present disclosure.
Figure 13:
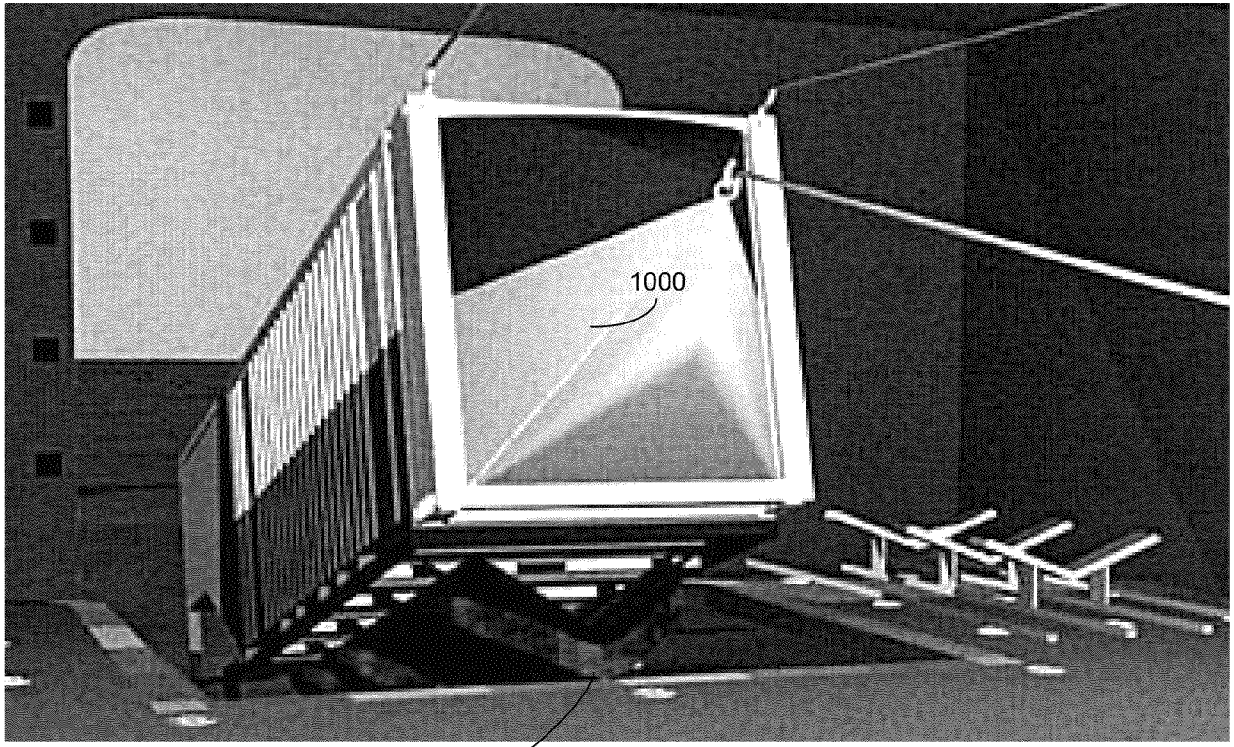
FIG. 13 is an illustrative diagrammatic view of a vessel according to one or more implementations of the present disclosure.

In some implementations, and as seen from example FIG. 10, vessel 200 may include a "sea truck", such as sea truck 1000. In the example, and referring at least to FIG. 11, rail 102, rail 104, rail 106, and/or rail 108 may use the top lifting holes in, e.g., the corner fittings of, e.g., an ISO container with commercial connectors to attach to the ISO container of sea truck 1000. In some implementations, lifting bars 202 may connect, e.g., to the top lifting holes of propulsion and bow units of sea truck 1000, which may allow sea truck 1000 lifting holes to remain open for use. In some implementations, lifting bars 202 may be integrated internally, e.g., to the bow and stern units of sea truck 1000 and may be deployed and/or retracted (using any of the above-noted techniques) from an internal storage compartment (not shown) within the propulsion and bow components. In some implementations, a transfer block may be integrated into lifting bars 202 such that, e.g., if lifting bars 202 were attached to the container, lifting bars 202 may remain ISO sized lifting holes on, e.g., the top surface of lifting bars 202 for transfer of the container with, e.g., intermodal handling equipment. This may allow the container to be pre-configured prior to attaching sea truck components. As noted above, and similarly with rail 102 and/or rail 104, lifting bars 202 may be one solid piece, hinged, telescoping, etc.

In some implementations, the above-noted large vessel may be configured for ramp appliqués to, e.g., allow V-bottom crafts, such as Rigid Hull Inflatable Boats (RHIBS), to be retrieved. In the example, and referring at least to FIG. 12, a bottom adapter (e.g., bottom adapter 1200), may be connected to an ISO container, e.g., via the bottom corner fittings, and may be utilized to attach a variable bottom surface that may function in one or more example ways:

1. It may be a conformal adapter allowing stowage in a RHIB or other small vessel rack.

2. The weight of the bottom adapter may function as a stability "keel".

3. It may function to improve the directional stability of the normally flat bottom sea truck.

4. It may provide additional longitudinal stability, e.g., if a V-Bottom ramp appliqué is used to retrieve the sea truck. An example illustration of one or more of the above examples may be seen at least at example FIG. 13.

Figure 14:
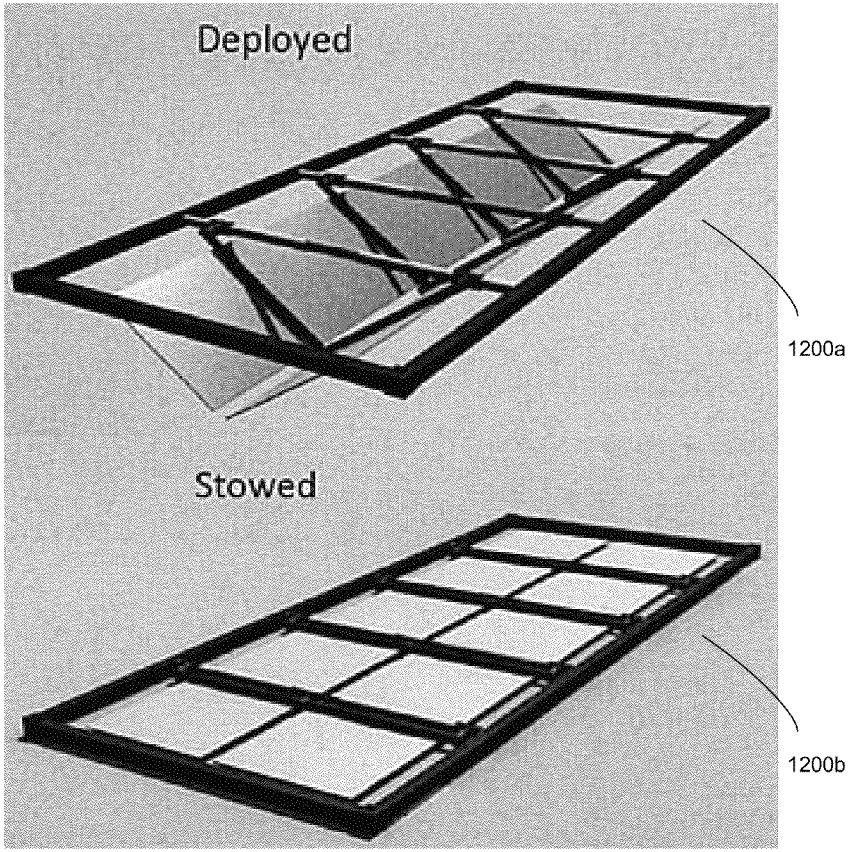
FIG. 14 is an illustrative diagrammatic view of a vessel according to one or more implementations of the present disclosure.

In some implementations, bottom adapter 1200 may be configured to fold into a smaller space for stowage, an example of which is shown at least at FIG. 14, where bottom adapter 1200 is both deployed (in 1200*a*) and stowed (in 1200*b*). For example, bottom adapter 1200 may include, e.g., a screw jack inside of a beam that may allow the length to increase through rotation of the screw. As a result, the internal beams within the adapter may be forced downward to form the bottom "hull" shape of the RHIB while firmly attached to the bottom of the container. As the basic outside shape of the bottom adapters may be similar or the same as an ISO container, flattening the bottom adapters and/or hooking them together to fill an ISO space claim may be accomplished. In the example, the ability to fold may allow for a number of bottom adapters to be stacked together, using ISO connectors, to fit within the space and weight claim of, e.g., a 20 foot container. Additionally/alternatively, it may allow for the bottom adapters to be handled by standard Intermodal Shipping devices aboard the above-noted larger vessels. Additionally/alternatively, apparatus 100 may be used to retrieve sea truck 1000 with attached bottom adapter 1200.

It will be appreciated that apparatus 100 (and/or vessel 200) may but need not include retrieval process 10, controller application 20, controller 215, client application 26, or combination thereof, to practice the above disclosure. For example, apparatus 100 and/or vessel 200 may merely by their aesthetical design aid in aligning and receiving, e.g., lifting bars 202 into the bell mouth (e.g., via gap portion 110 as the distance between gap portion 110 and lifting bars 202 of vessel 200 decreases) and into the throat of apparatus 100 (e.g., via gap portion 112 as the distance between gap portion 112 and lifting bars 202 of vessel 200 decreases). As such, the use of retrieval process 10, controller application 20, controller 215, client application 26, or combination thereof, to practice the above disclosure should be taken as an example only and not to limit the scope of the disclosure.

The terminology used herein is for the purpose of describing particular implementations only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps (not necessarily in a particular order), operations, elements, and/or components, but do not preclude the presence or addition of one or more other features, integers, steps (not necessarily in a particular order), operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications, variations, and any combinations thereof will be apparent to those of ordinary skill in the art without departing from the scope and spirit of the disclosure. The implementation(s) were chosen and described in order to best explain the principles of the disclosure and the practical application, and to enable others of ordinary skill in the art to understand the disclosure for various implementation(s) with various modifications and/or any combinations of implementation(s) as are suited to the particular use contemplated.

Having thus described the disclosure of the present application in detail and by reference to implementation(s) thereof, it will be apparent that modifications, variations, and any combinations of implementation(s) (including any modifications, variations, and combinations thereof) are possible without departing from the scope of the disclosure defined in the appended claims.

What is claimed is:

1. An apparatus configured to capture a target object from a body of water comprising:

a first rail;

a second rail positioned in a horizontal plane above the first rail to form a first vertical gap;

a first gap portion of the first vertical gap formed between at least a portion of the first and second rail, the first and second rail configured to align and receive, via the first gap portion, at least a portion of the target object as a distance between the first gap portion and at least the portion of the target object decreases; and a second gap portion of the first vertical gap formed between at least the portion of the first and second rail, the first and second rail further configured to align and receive at least the portion of the target object via the second gap portion as a distance between the second gap portion and at least the portion of the target object decreases; and one or more stabilizing portions directly coupled to one or more of the first and second rails configured to stabilize the first and second rail during alignment.

2. The apparatus of claim 1 wherein the one or more stabilizing portions include one or more ballasts coupled to one or more of the first and second rails.

3. The apparatus of claim 1 wherein the one or more stabilizing portions include one or more portions configured to receive one or more cables operatively connected to a crane.

4. The apparatus of claim 2 wherein the one or more ballasts is configured to dynamically stabilize the first and second rail.

5. The apparatus of claim 2 wherein the one or more ballasts includes a cylinder with one or more slots.

6. The apparatus of claim 1 wherein at least one of the first and second rail is further configured to extend and retract.

7. The apparatus of claim 1 further comprising at least one of a motor, an engine, and a thruster configured to navigate at least one of the first and second rail.

8. The apparatus of claim 1 further comprising a catch configured to, after at least the portion of the target object is proximate to the catch, prevent at least the portion of the target object from moving in one or more directions.

9. The apparatus of claim 1 wherein at least one of the first and second rail includes at least one of a straight and a curved shape.

10. An apparatus configured to capture a target object from a body of water comprising:

a first rail;

a second rail positioned in a horizontal plane above the first rail to form a first vertical gap;

a third rail;

a fourth rail positioned in a horizontal plane above the third rail to form a second vertical gap;

a first gap portion of the first vertical gap formed between at least a portion of the first and second rail, the first and second rail configured to align and receive, via the first gap portion, at least a portion of the target object as a distance between the first gap portion and at least the portion of the target object decreases;

a second gap portion of the first vertical gap formed between at least the portion of the first and second rail, the first and second rail further configured to align and receive at least the portion of the target object via the second gap portion as a distance between the second gap portion and at least the portion of the target object decreases;

a third gap portion of the second vertical gap formed between at least a portion of the third and fourth rail, the third and fourth rail configured to align and receive, via the third gap portion, at least a second portion of the target object as a distance between the third gap portion and at least the second portion of the target object decreases; and a fourth gap portion of the second vertical gap formed between at least the portion of the third and fourth rail, the third and fourth rail further configured to align and receive at least the second portion of the target object via the fourth gap portion as a distance between the fourth gap portion and at least the second portion of the target object decreases.

11. The apparatus of claim 10 further comprising one or more stabilizing portions configured to stabilize at least one of the first, second, third, and fourth rail.

12. The apparatus of claim 11 wherein the one or more stabilizing portions include one or more ballasts coupled to one or more of the first, second, third, and fourth rails.

13. The apparatus of claim 11 wherein the one or more stabilizing portions include one or more portions configured to receive one or more cables operatively connected to a crane.

14. The apparatus of claim 12 wherein the one or more ballasts is configured to dynamically stabilize at least one of the first, second, third, and fourth rail.

15. The apparatus of claim 12 wherein the one or more ballasts includes a cylinder with one or more slots.

16. The apparatus of claim 10 wherein at least one of the first, second, third, and fourth rail is further configured to extend and retract.

17. The apparatus of claim 10 further comprising at least one of a motor, an engine, and a thruster configured to navigate at least one of the first, second, third, and fourth rail.

18. The apparatus of claim 10 further comprising a catch configured to, after at least the portion of the target object is proximate to the catch, prevent at least the portion of the target object from moving in one or more directions.

19. The apparatus of claim 10 wherein at least one of the first, second, third, and fourth rail includes at least one of a straight and a curved shape.

20. A method for capturing a target object from a body of water comprising:

aligning a first and second rail coupled to a capture object with at least a portion of the target object, wherein the first rail is positioned in a horizontal plane above the second rail to form a first vertical gap;

receiving, via a first gap portion of the first vertical gap formed between at least a portion of the first and second rail, at least the portion of the target object as a distance between the first gap portion and at least the portion of the target object decreases;

aligning, via the first and second rail, a second gap portion of the first vertical gap formed between at least the portion of the first and second rail with at least the portion of the target object; and receiving, at the second gap portion via the first and second rail, at least the portion of the target object as a distance between the second gap portion and at least the portion of the target object decreases, wherein receiving at the first and second gap portion at least the portion of the target object includes reducing the displacements between the target object and the capture object and aligning the target object and the capture object when at least a portion of the target object is at least partially above the body of water, wherein aligning at least one of the first and second gap portion includes stabilizing at least one of the first and second rail using one or more ballasts.

21. The method of claim 20 wherein at least one of the first and second rail are dynamically stabilized via, at least in part, the one or more ballasts coupled to one or more of the first and second rails.

22. The method of claim 20 wherein aligning at least one of the first and second gap portion includes at least one of extending and retracting at least one of the first and second rail.

23. The method of claim 20 wherein aligning at least one of the first and second gap portion includes navigating at least one of the first and second rail via at least one of a motor, an engine, and a thruster.

24. The method of claim 20 further comprising preventing, via a catch, at least the portion of the target object from moving in one or more directions after at least the portion of the target object is proximate to the catch.

25. The method of claim 20 further comprising lifting at least the portion of the target object in a vertical direction after at least one of the first and second gap portion, via the first and second rail, is aligned and received.

* * * * *